US007467969B2

(12) United States Patent
Liu et al.

(10) Patent No.: US 7,467,969 B2
(45) Date of Patent: Dec. 23, 2008

(54) CABLE CONNECTOR ASSEMBLY WITH WIRE MANAGEMENT MEMBER

(75) Inventors: Su-Feng Liu, Kunshan (CN); Wei-Ya Cheng, Kunshan (CN); Bin Xu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,170

(22) Filed: Jan. 17, 2008

(65) Prior Publication Data

US 2008/0171476 A1 Jul. 17, 2008

(51) Int. Cl.
*H01R 12/24* (2006.01)

(52) U.S. Cl. ..... 439/493; 439/497; 439/701

(58) Field of Classification Search ..... 439/493, 439/497, 701

See application file for complete search history.

(56) References Cited

U.S. PATENT DOCUMENTS 4,753,005 A * 6/1988 Hasircoglu ..... 29/829
4,871,319 A * 10/1989 Babow ..... 439/77
5,049,090 A * 9/1991 Johnson ..... 439/493
5,272,807 A * 12/1993 Henschen et al. ..... 29/863
5,358,426 A * 10/1994 Henschen et al. ..... 439/497
5,387,124 A * 2/1995 Shinohara et al. ..... 439/497
6,380,485 B1 4/2002 Beaman
6,540,548 B1 4/2003 Zhang
6,685,501 B1 2/2004 Wu
6,802,744 B2 10/2004 Chiang
6,869,308 B2 3/2005 Wu
7,273,390 B2 * 9/2007 Iida et al. ..... 439/494
7,275,953 B2 * 10/2007 Brown et al. ..... 439/493

* cited by examiner

*Primary Examiner*—Truc T Nguyen
(74) *Attorney, Agent, or Firm*—Wei Te Chung

(57) ABSTRACT

A cable connector assembly (100) according to the present invention includes an insulator (2), a PCB (5) and a wire management member (4). The insulator includes a front side, a rear side, a number of terminal passages (24) between the front side and the rear side, and a number of terminals (3) respectively mounted in the terminal passages, each of the terminals has a tail (33) extended out of the rear side of the insulator. The PCB is located behind the insulator and includes a number of first conductive pads (51) which connect with the corresponding terminals and a number of second conductive pads (52) which is soldered to a number of wires (6), the first conductive pads electrically connect with the corresponding second conductive pads. The wire management member is held by the insulator, and defines a number of wire management grooves (421) above the PCB and adjacent to the second conductive pads, the wire management grooves receives the corresponding wires for enabling the wires to be respectively soldered to the second conductive pads.

20 Claims, 7 Drawing Sheets

CABLE CONNECTOR ASSEMBLY WITH WIRE MANAGEMENT MEMBER

BACKGROUND OF THE INVENTION

1. Field of the Invention

This invention generally relates to a cable connector assembly, and more particularly, to a cable connector assembly with a wire management member for a PCB and wires thereof.

2. Description of the Prior Art

U.S. Pat. No. 6,685,501 B1 discloses a high speed cable connector including a cover, a base and a cable assembly mounted between the cover and the base. The cable assembly includes a cable consisting of a plurality of lines. Each line has a signal pair and a ground conductor. The signal pair includes a pair of upper and lower signal conductors. The ground conductors are soldered to shielding plates. The shielding plates are soldered to top and bottom faces of a rear end of a printed circuit board (PCB). The upper and lower signal conductors of each signal pair are soldered to the top and bottom faces of the rear end of the PCB, respectively, and located between two neighboring shielding plates, whereby cross-talk and interference between two neighboring signal pairs can be effectively suppressed and reduced. The PCB has a front end electrically connecting with contacts for electrically engaging with a complementary connector. However, it is very complicated to solder so many shielding plates onto the PCB.

Hence, an improved cable connector assembly is desired to overcome the above problems.

BRIEF SUMMARY OF THE INVENTION

It is an object of the present invention to provide a cable connector assembly with a wire management member for a PCB.

In order to attain the object above, a cable connector assembly according to the present invention comprises an insulator, a PCB and a wire management member. The insulator comprises a front side, a rear side, a plurality of terminal passages between the front side and the rear side, and a plurality of terminals respectively mounted in the terminal passages, each of the terminals has a tail extended out of the rear side of the insulator. The PCB is located behind the insulator and comprises a plurality of first conductive pads which connect with the corresponding terminals and a plurality of second conductive pads which is soldered to a plurality of wires, the first conductive pads electrically connect with the corresponding second conductive pads. The wire management member is held by the insulator, and defines a plurality of wire management grooves above the PCB and adjacent to the second conductive pads, the wire management grooves receives the corresponding wires for enabling the wires to be respectively soldered to the second conductive pads.

In order to attain the object above, a cable connector assembly according to the present invention comprises an insulator, a PCB and a wire management member. The insulator comprises a front side, a rear side, a plurality of terminal passages between the front side and the rear side, a cavity opening rearwards, and a plurality of terminals respectively mounted in the terminal passages, each of the terminals has a tail extended out of said rear side of the insulator. The PCB is located behind the insulator and comprises a top surface and a bottom surface, the top surface has a plurality of first conductive pads which are soldered to the corresponding terminals, the bottom surface has a plurality of second conductive pads which is soldered to a plurality of wires, the first conductive pads electrically connects with the corresponding second conductive pads. The wire management member comprises a projection and a plurality of wire management grooves extending rearwards from the projection, the projection is received in the cavity to hold the wire management member on the insulator, the wire management grooves are located on the bottom surface of the PCB and adjacent to the second conductive pads, the wire management grooves receives the corresponding wires for enabling the wires to be respectively soldered to the second conductive pads.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
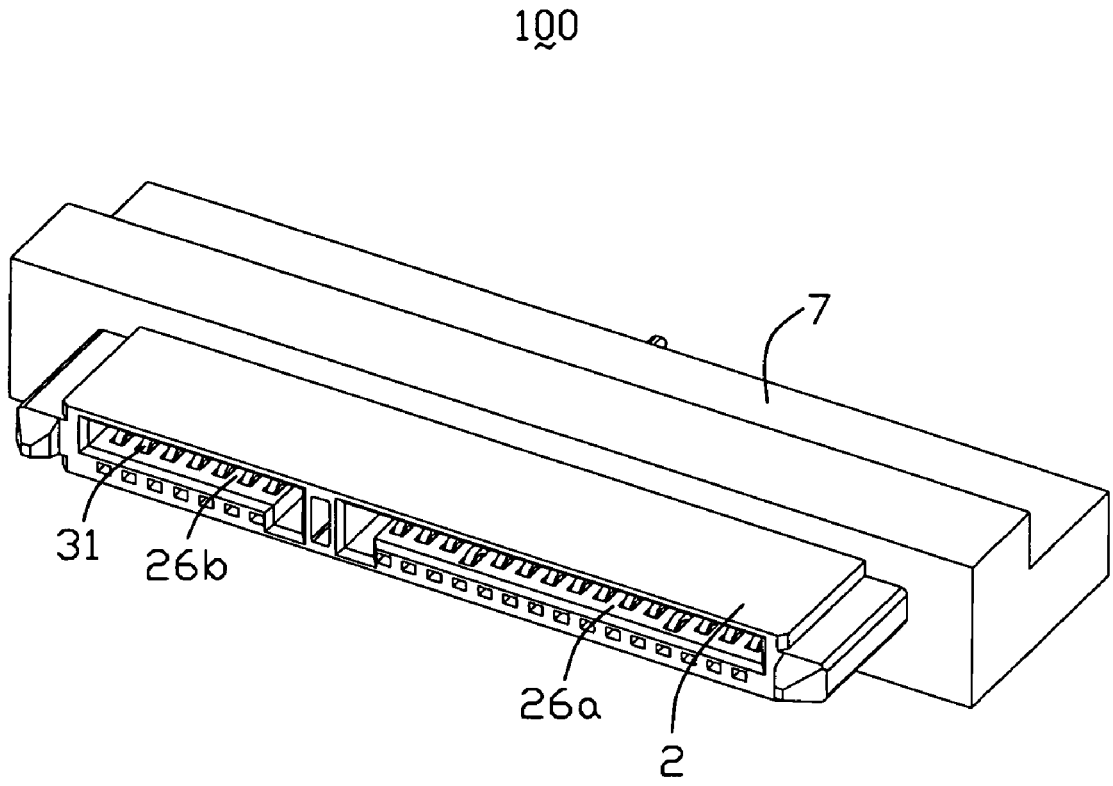
FIG. 1 is an assembled view of a cable assembly according to the present invention.
Figure 2:
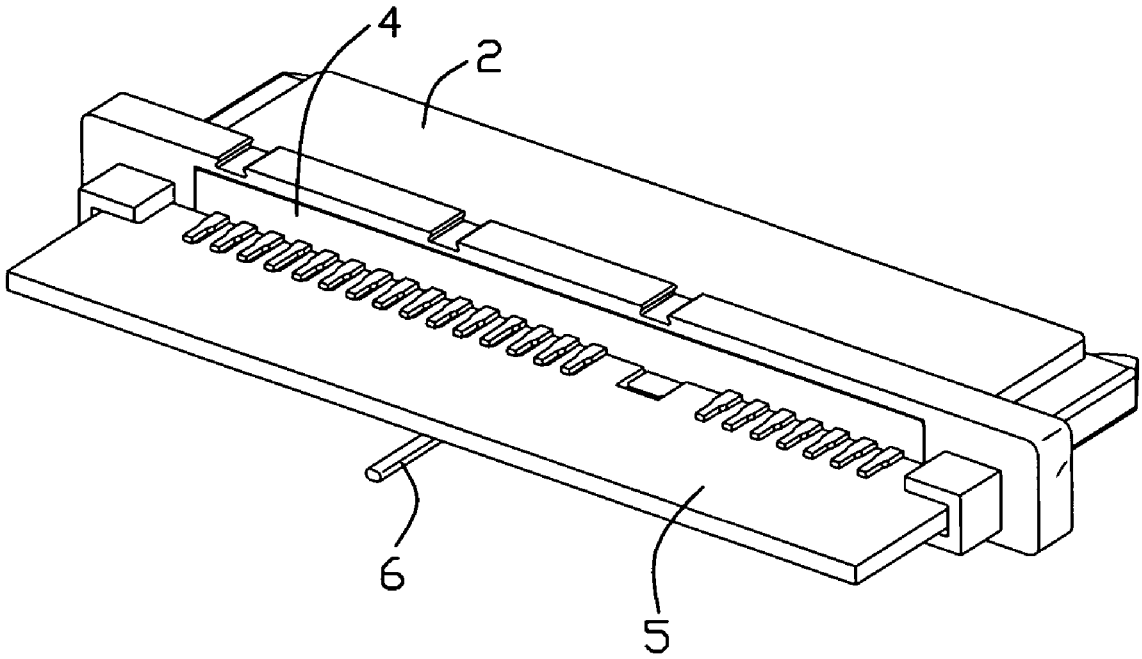
FIG. 2 is an assembled view before a casing is assembly onto the cable connector assembly.

Reference will now be made in detail to the preferred embodiment of the present invention.

Please referring to FIGS. 1 through 7, a cable connector assembly 100 in accordance with the present invention includes an insulator 2, a plurality of conductive terminals 3 held in the insulator 2, a PCB (printed circuit board) 5 lying behind the insulator 2 and electrically communicating with the terminals 3, a wire management member 4 mounted on the rear end of the insulator 2 and used for managing wires, and a plurality of wires soldered on the PCB 5 to electrically connect the corresponding terminals 3.

Figure 6:
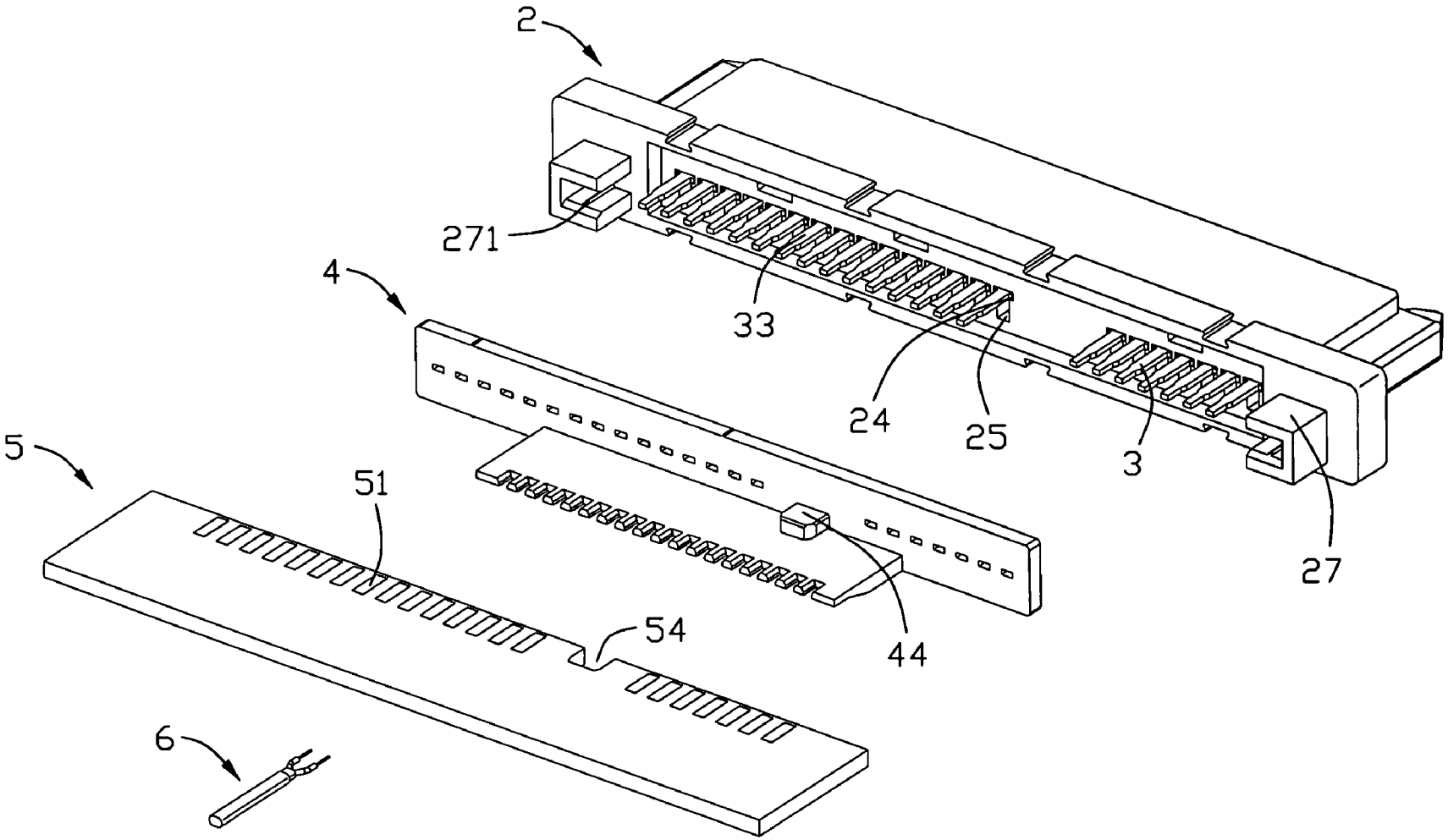
FIG. 6 is an exploded, perspective view of the cable assembly shown in FIG. 1.
Figure 7:
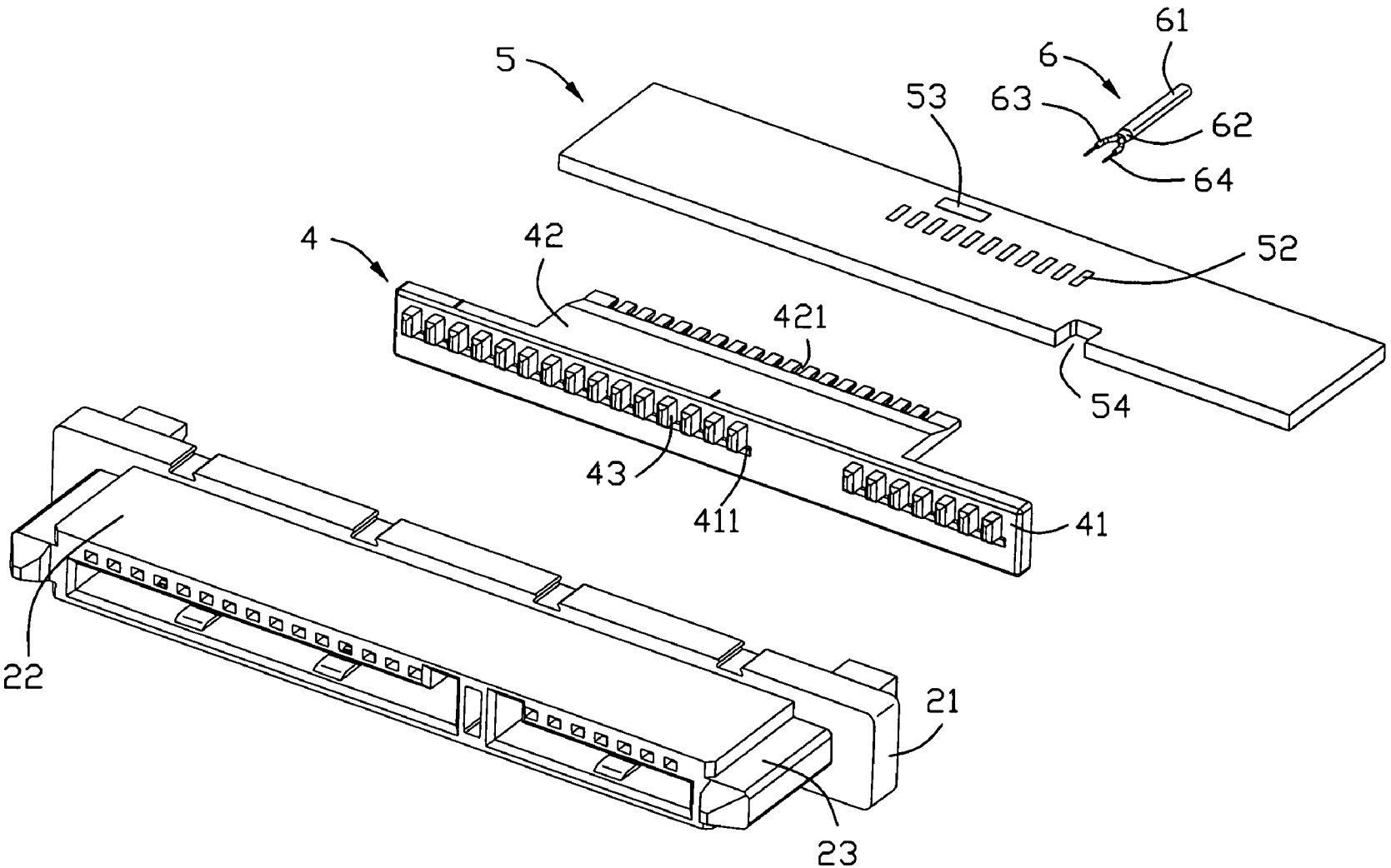
FIG. 7 is a view similar to FIG. 6, but viewed from another aspect.

Please refer to FIGS. 1, 6 and 7. The insulator 2 includes a base 21, a tongue portion 22 extending forwards from the base 21, and a pair of guiding posts 23 at the edges of the tongue portion 22. A plurality of terminal passages 24 are defined through the base 21 and the tongue portion 22 to accommodate conductive terminals 3. A plurality of cavities 25 are formed below and contiguous with the corresponding terminal passages 24. In the tongue portion 22 there are a pair of L-shaped receiving spaces 26*a*, 26*b* used for receiving a complementary connector. The pair of L-shaped receiving spaces 26*a*, 26*b* communicates with the corresponding terminal passages 24 and cavities 25 in order to expose the terminals 3 in the receiving spaces 26*a*, 26*b*.

Figure 4:
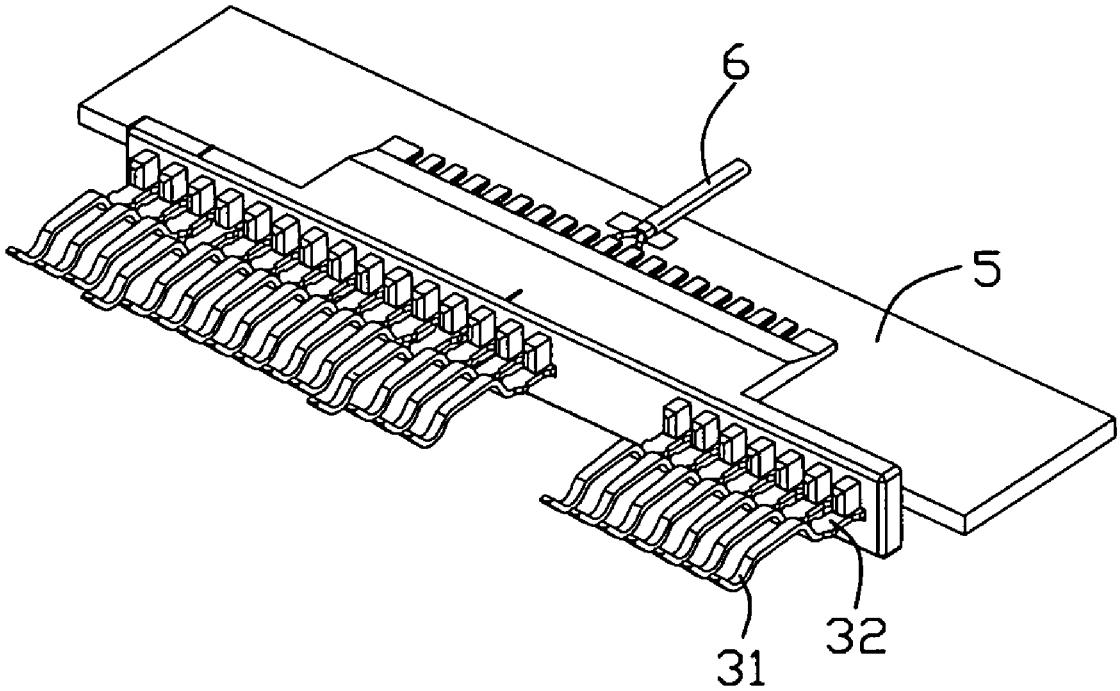
FIG. 4 is an partial view of the cable assembly shown in FIG. 1.
Figure 5:
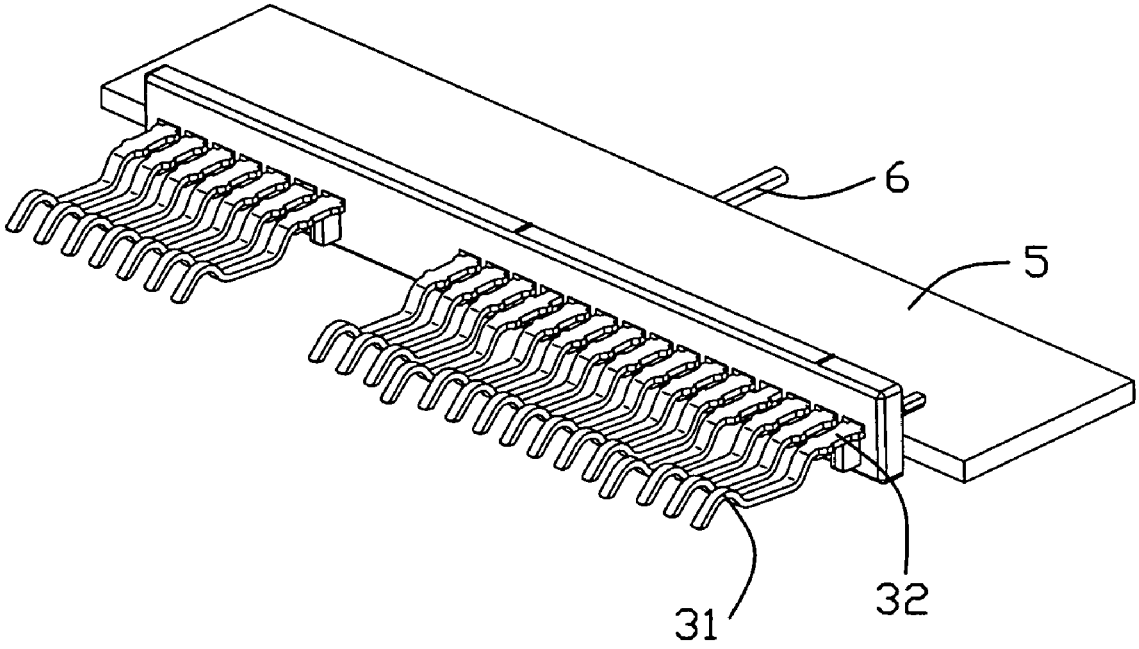
FIG. 5 is a view similar to FIG. 4, but viewed from another aspect.

Please refer to FIGS. 1, 4 and 6. Each conductive terminal 3 includes an elastic contact portion 31 in the front thereof, a middle portion 32 extending backwards from the elastic contact portion 31, a tail 33 at the rear end thereof. The elastic contact portion 31 is wider than the terminal passage 24 in a vertical direction, so only in help of the cavity 25 the terminal 3 is able to extend into the insulator 3. The middle portion 32 forms two pairs of forks (not labeled) to hold the terminal 3 in the insulator 2 and hold the terminal 3 and the wire management member 4 together. The tail 33 extends beyond the base 21 and is soldered onto the PCB 5.

Please refer to FIGS. 6 and 7, a plurality of first conductive pads 51 are formed in the front of the top surface of the PCB 5 and used for electrical connection with the tail 33 of the conductive terminals 3. A plurality of second conductive pads 52 are formed on the bottom surface of the PCB 5 and used for electrical connection with the corresponding wires. There is a third conductive pad 53 behind the second conductive pads 52 for grounding. A rectangular cave 54 is defined in the front of the PCB 5 and opens forwards.

Please refer to FIGS. 2 through 7. The wire management member 4 is made of insulative material and includes a baffle board 41, a wire management board 42 extending backwards from the baffle board 41 and a plurality of projection rods 43 extending forwards from the baffle board 41. The baffle board 41 is rectangular, and defines front and rear surfaces and a plurality of terminal slots 411 through the front and rear surfaces. The terminal slots 411 communicates with the corresponding terminal passages 24 of the insulator 2 so that the tail 33 of the conductive terminals 3 can extend through the baffle board 41 to connect with the PCB 5. The through holes 411 and the corresponding conductive terminals 3 cooperate closely to prevent melted plastic or melted solder from extending to the elastic contact portion 31. One pair of the forks of the terminal 3 engage with the terminal slots 411 to make them together. The projection rods 43 are below the terminal slots 411, and inserted into the corresponding cavities 25 to hold the wire management member 4 on the insulator 2. Front portions of the projection rods 43 are narrower to guide the projection rods 43.

The wire management board 42 is generally in the same surface, and has a rectangular base and defines in the rear portion thereof a plurality of wire management grooves 421 to align and accommodate front ends of the wires. Each wire management groove 421 is rectangular, and runs through the top and bottom surfaces in the vertical direction to communicate with the PCB 2 and outside, and opens back in the front-to-rear direction to insert the wires into the wire management grooves 421 from the rear-to-front direction. The second conductive pads 52 are respective under the corresponding wire management grooves 421 so that conductive cores 64 of the wires which are received in the wire management grooves 421 stand on and electrically connect with the corresponding second conductive pads 52. The wire management board 42 with wire management grooves 421 can effectively reduce the difficulty of wires array, reduce production time and cost. Moreover, even if the conductive cores 64 received in the wire management grooves 421 may still swing, it can prevent solder bridge by the wire management board 42.

A protruding tab 44 extends backwards from the baffle board 41 and connects with the upper surface of the wire management board 42. In assembly, the rectangular cave 54 of the PCB 5 receives the protruding tab 44 to prevent the PCB from mis-engaging.

Figure 3:
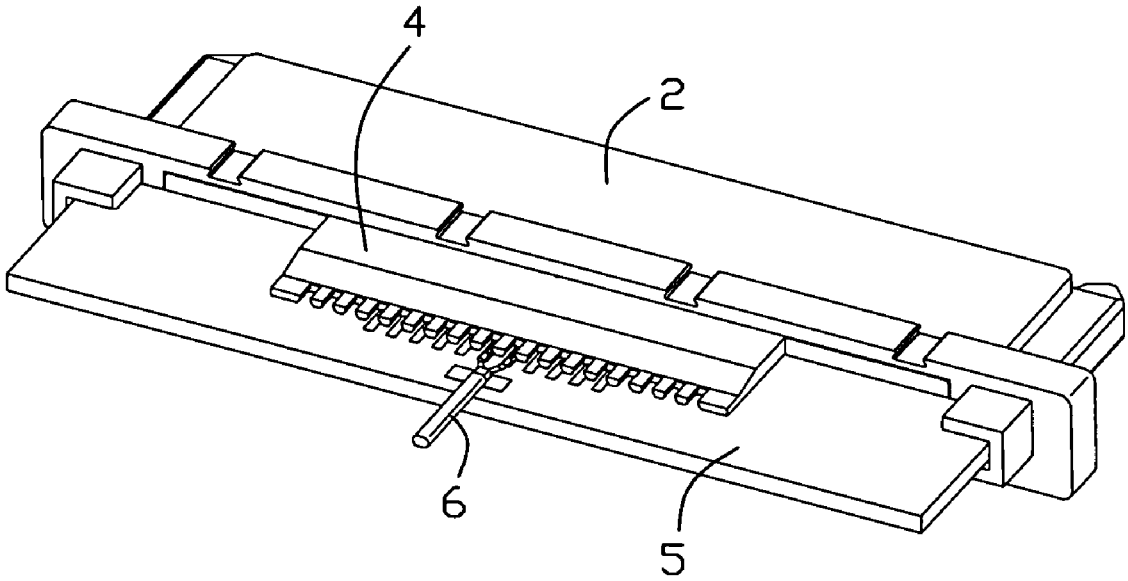
FIG. 3 is a view similar to FIG. 2, but viewed from another aspect.

Please referring to FIGS. 3 and 6, a pair of U-shaped grooves 27 extend backwards from lateral sides of the base 21 to accommodate the front end of the PCB 5. A convex rib 271 is formed on the inner surface of each U-shaped groove to interfere with the PCB 5.

The wires comprise a plurality of power wires (not shown in the Figures) with a large size for power transmission, and a plurality of signal wires 6 with small size for signal transmission. Each power wire is composed of an outer jacket at the outmost thereof, and a conductive core at the innermost thereof. Each signal wire 6 is composed of an outer jacket 61 at the outmost thereof, a grounding layer 62 formed below the outer jacket 61, a pair of inner insulative layers 63 formed below the grounding layer 62, and a pair of conductive cores 64 at the innermost thereof. The grounding layer is a metal braid layer. The outer jacket 61 of each signal wire 6 is stripped off at a front end thereof to expose the grounding layer 62 as being a grounding segment of the wire 6. The grounding segment of each signal wire **40*b* is then respectively soldered with the third conductive pad 53 of the PCB 5. Each signal wire 6 in part is further stripped off to expose the conductive cores 64 as being a signal segment which extends into the wire-receiving passageways 421 for electrically connecting corresponding second conductive pad 52. Finally, an insulative casing 7 (shown in FIG. 1) is formed by molding to cover the insulator 2, the PCB 5 and the wire management member 4**.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly, comprising:

an insulator comprising a front side, a rear side, a plurality of terminal passages between said front side and said rear side, and a plurality of terminals respectively mounted in the terminal passages, the terminals each having a tail extended out of said rear side of the insulator;

a PCB located behind the insulator and comprising a plurality of first conductive pads which connect with the corresponding terminals and a plurality of second conductive pads which is soldered to a plurality of wires, the first conductive pads electrically connecting with the corresponding second conductive pads; and a wire management member, the wire management member held by the insulator, and defining a plurality of wire management grooves above the PCB and adjacent to the second conductive pads, the wire management grooves receiving the corresponding wires for enabling the wires to be respectively soldered to the second conductive pads.

2. The cable connector assembly according to claim 1, wherein the wire management grooves opens to the corresponding second conductive pads so that the wires received in the wire management grooves connect with the second conductive pads.

3. The cable connector assembly according to claim 1, wherein a plurality of cavities are defined contiguous with the corresponding terminal passages to insert the terminals into the insulator in assistance with the terminal passages, and a plurality of projection rod formed with the wire management member are inserted into the corresponding cavities to prevent the terminals from withdrawing and hold the wire management on the insulator.

4. The cable connector assembly according to claim 1, wherein the insulator comprises a cavity between said front side and said rear side, and the wire management member comprises a projection rod received in the cavity to hold the wire management member on the insulator.

5. The cable connector assembly according to claim 1, wherein the wire management member further comprises a baffle board formed integral with and in front of the wire management grooves, and the baffle board has a plurality of terminal slots to permit the terminals to pass through.

6. The cable connector assembly according to claim 5, wherein a projection rod projects forwards from the baffle board, and the rear side of the insulator comprises a cavity to receive the projection rod.

7. The cable connector assembly according to claim 5, wherein the rear side of the insulator defines a room shaped the same with the baffle board to receive the baffle board.

8. A cable connector assembly, comprising:

an insulator comprising a front side, a rear side, a plurality of terminal passages between said front side and said rear side, a cavity opening rearwards, and a plurality of terminals respectively mounted in the terminal passages, the terminals each having a tail extended out of said rear side of the insulator;

a PCB located behind the insulator and comprising a top surface and a bottom surface, the top surface having a plurality of first conductive pads which are soldered to the corresponding terminals, the bottom surface having a plurality of second conductive pads which is soldered to a plurality of wires, the first conductive pads electrically connecting with the corresponding second conductive pads; and a wire management member comprising a projection and a plurality of wire management grooves extending rearwards from the projection, the projection being received in the cavity to hold the wire management member on the insulator, the wire management grooves located on the bottom surface of the PCB and adjacent to the second conductive pads, the wire management grooves receiving the corresponding wires for enabling the wires to be respectively soldered to the second conductive pads.

9. The cable connector assembly according to claim 8, wherein the wire management grooves opens to the corresponding second conductive pads so that the wires received in the wire management grooves connect with the second conductive pads.

10. The cable connector assembly according to claim 8, wherein the cavity is contiguous with one of the terminal passages.

11. The cable connector assembly according to claim 8, wherein the wire management member further comprises a baffle board extending beyond the top surface and the bottom surface of the PCB in a vertical direction, and the baffle board comprises a plurality of terminal slots to permit the tails of the terminals to pass through, and said projection projects forwards from the baffle board.

12. The cable connector assembly according to claim 11, wherein the rear side of the insulator defines a room shaped the same with the baffle board to receive the baffle board.

13. The cable connector assembly according to claim 11, wherein a rectangular wire management board projects rearwards to a rear end of the PCB from the baffle board, and the wire management board is below and abuts against the PCB; said wire management grooves is defined in the rear end of the wire management board.

14. The cable connector assembly according to claim 8, wherein the wire management member further comprises a baffle board extending beyond the top surface and the bottom surface of the PCB in a vertical direction, the baffle board comprises a plurality of terminal slots to permit the tails of the terminals to pass through, and said projection is below one of the terminal slots; in accordance, said cavity is contiguous with and behind one of the terminal passages.

15. An electrical connector comprising:

an insulative housing defining a mating end and a connection end;

a plurality of contacts disposed in the housing, each of said contacts defining a mating section exposed around the mating end, and a tail section extending out of the connection end;

a wire organizer intimately position behind the connection end and defining a first plate, which is generally defined in an up-and-down direction, with therein a plurality of through holes through which said tail sections guidably extend, and a second plate, which is generally defined in a front-to-back direction and defining a plurality of slots therein; and a printed circuit board positioned behind the wire organizer and defining first and second solder pads respectively on opposite first and second surfaces thereof; wherein the first solder pads are electrically and mechanically connected to the corresponding tail sections, and the second solder pads are respectively exposed in the corresponding slots to electrically and mechanically connect said corresponding wires which are respectively received in the corresponding slots.

16. The connector as claimed in claim 15, further including complementary interengaging devices between the wire organizer and the printed circuit board.

17. The connector as claimed in claim 15, wherein second plate is essentially seated upon second surface of the printed circuit board.

18. The connector as claimed in claim 17, wherein a thickness of the printed circuit board is similar to a distance between a sitting face of the second plate on which the second surface of the printed circuit board is seated, and a common line which is defined by said through holes in a transverse direction perpendicular to said front-to-back direction and said up-and-down direction.

19. The connector as claimed in claim 15, where said first plate extends vertically.

20. The connector as claimed in claim 15, wherein said second plate extends horizontally.

* * * * *